US006830552B1

(12) United States Patent
Gonzalez

(10) Patent No.: US 6,830,552 B1
(45) Date of Patent: Dec. 14, 2004

(54) BACKSCRATCHER WITH A TELESCOPICALLY ADJUSTABLE SHAFT AND WITH A PLURALITY OF SCREW-ON ATTACHMENT END PIECES

(76) Inventor: Mark Antonio Gonzalez, 12851 Portola St., Victorville, CA (US) 92392

( * ) Notice: Subject to any disclaimer, the term of this patent is extended or adjusted under 35 U.S.C. 154(b) by 0 days.

(21) Appl. No.: 10/425,435

(22) Filed: Apr. 29, 2003

(51) Int. Cl.[7] ..... A61H 7/00
(52) U.S. Cl. ..... 601/137; D28/91.2
(58) Field of Search ..... 601/125, 111, 601/46, 80, 101, 107, 136, 137, 144, 154, 72; 606/237–239; D28/91.2, 7, 63, 99; D7/643, 653

(56) References Cited

U.S. PATENT DOCUMENTS

| | | | | | |
|---|---|---|---|---|---|
| 869,250 | A | | 10/1907 | Martin | |
| 4,091,805 | A | * | 5/1978 | Clark | 601/80 |
| 4,530,369 | A | * | 7/1985 | Adams | 132/311 |
| D368,413 | S | * | 4/1996 | Lowenfels | D7/653 |
| 5,560,746 | A | * | 10/1996 | Willow | 601/135 |
| 5,673,455 | A | | 10/1997 | Per-Lee et al. | 15/210.1 |
| D392,424 | S | * | 3/1998 | Burys | D28/99 |
| 5,873,175 | A | * | 2/1999 | Johnston | 33/809 |
| 5,904,661 | A | * | 5/1999 | Bonz et al. | 601/137 |
| 5,906,509 | A | | 5/1999 | Wu | 15/244.2 |
| 6,182,539 | B1 | * | 2/2001 | Webster | 81/177.2 |

FOREIGN PATENT DOCUMENTS

| | | | | | |
|---|---|---|---|---|---|
| JP | 09122191 | A | * | 5/1997 | A61H/7/00 |

* cited by examiner

*Primary Examiner*—Nicholas D. Lucchesi
*Assistant Examiner*—Quang D Thanh
(74) *Attorney, Agent, or Firm*—Goldstein Law Offices, P.C.

(57) ABSTRACT

A backscratcher having a telescopically adjustable shaft and a plurality of interchangeable attachment end pieces. The shaft has a plurality of segments which may be telescopically positioned within one another, in order to maximally extend the shaft, or alternately, to retract the shaft into a storage position. The shaft terminates at one end with an attachment segment having a threaded bore, thereby allowing selective attachment to corresponding threads located upon the attachment end pieces. The shaft terminates at its other end with an outermost segment having a clip on its outside surface, thereby allowing selective attachment of the backscratcher to a pocket on an item of clothing worn by a user. The interchangeable attachment end pieces include two backscratchers, a mirror, a pen, a fork, a spoon, a hand pointer, a business card holder, a toothbrush, a Phillips screwdriver, a magnet, an alligator clip, and a multiple attachment end piece.

3 Claims, 4 Drawing Sheets

BACKSCRATCHER WITH A TELESCOPICALLY ADJUSTABLE SHAFT AND WITH A PLURALITY OF SCREW-ON ATTACHMENT END PIECES

BACKGROUND OF THE INVENTION

1. Field of the Invention

The invention generally relates to a backscratcher, and in particular it relates to a backscratcher having a telescopically adjustable shaft and a plurality of screw-on attachment end pieces. The attachment end pieces include a standard backscratcher end piece, a mirror end piece, a pen end piece, a fork end piece, a spoon end piece, an alligator teeth backscratcher end piece, a hand pointer end piece, a business card holder end piece, a toothbrush end piece, a Phillips screwdriver end piece, a magnet end piece, an alligator clip end piece, and a multiple attachment end piece.

2. Description of the Related Art

A variety of extension devices are available for moving a contact surface against hard-to-reach areas upon a person's back. U.S. Pat. No. 5,673,455 to Per-Lee appears to show a device for applying skin treatment products to the back of a person. However, Per-Lee is not equipped with a backscratcher attachment for relieving an itch which has developed upon a hard-to-reach area of a person's back.

Additionally, U.S. Pat. No. 5,960,509 to Wu appears to show a back brush tool with a plurality of interchangeable brush heads. However, Wu fails to provide a tool with a back-scratching attachment for relieving an itch which has developed upon a person's back.

Furthermore, U.S. Pat. No. 869,250 to Martin appears to show a backscratcher having an elongated shaft, for scratching hard to reach areas upon a person's back. However, Martin provides a fixed handle which cannot be adjusted if the user so requires.

While the aforementioned devices may be suitable for the particular purpose employed, or for general use, they would not be as suitable for the purposes of the present invention as disclosed hereafter.

SUMMARY OF THE INVENTION

It is an object of the invention to produce a backscratcher which may be used to relieve an itch which has developed on a hard-to-reach area of a user's back. Accordingly, the backscratcher is provided with two backscratcher attachment end pieces which may be used to relieve an itch which has developed on a hard-to-reach area of a user's back.

It is another object of the invention to produce a backscratcher which may be compactly stored when not being used. Accordingly, the backscratcher has a telescopically adjustable shaft, thereby allowing the backscratcher to be compactly stored when not being used.

It is yet another object of the invention to produce a backscratcher which may be used for purposes other than for merely scratching the back of the user. Accordingly, the backscratcher is provided with a variety of attachment end pieces, each having a different function, thereby allowing use of the backscratcher for purposes other than for merely scratching the back of the user.

The invention is a backscratcher having a telescopically adjustable shaft and a plurality of interchangeable attachment end pieces. The shaft has a plurality of segments which may be telescopically positioned within one another, in order to maximally extend the shaft, or alternately, to retract the shaft into a storage position. The shaft terminates at one end with an attachment segment having a threaded bore, thereby allowing selective attachment to corresponding threads located upon the attachment end pieces. The shaft terminates at its other end with an outermost segment having a clip on its outside surface, thereby allowing selective attachment of the backscratcher to a pocket on an item of clothing worn by a user. The interchangeable attachment end pieces include two backscratchers, a mirror, a pen, a fork, a spoon, a hand pointer, a business card holder, a toothbrush, a Phillips screwdriver, a magnet, an alligator clip, and a multiple attachment end piece.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
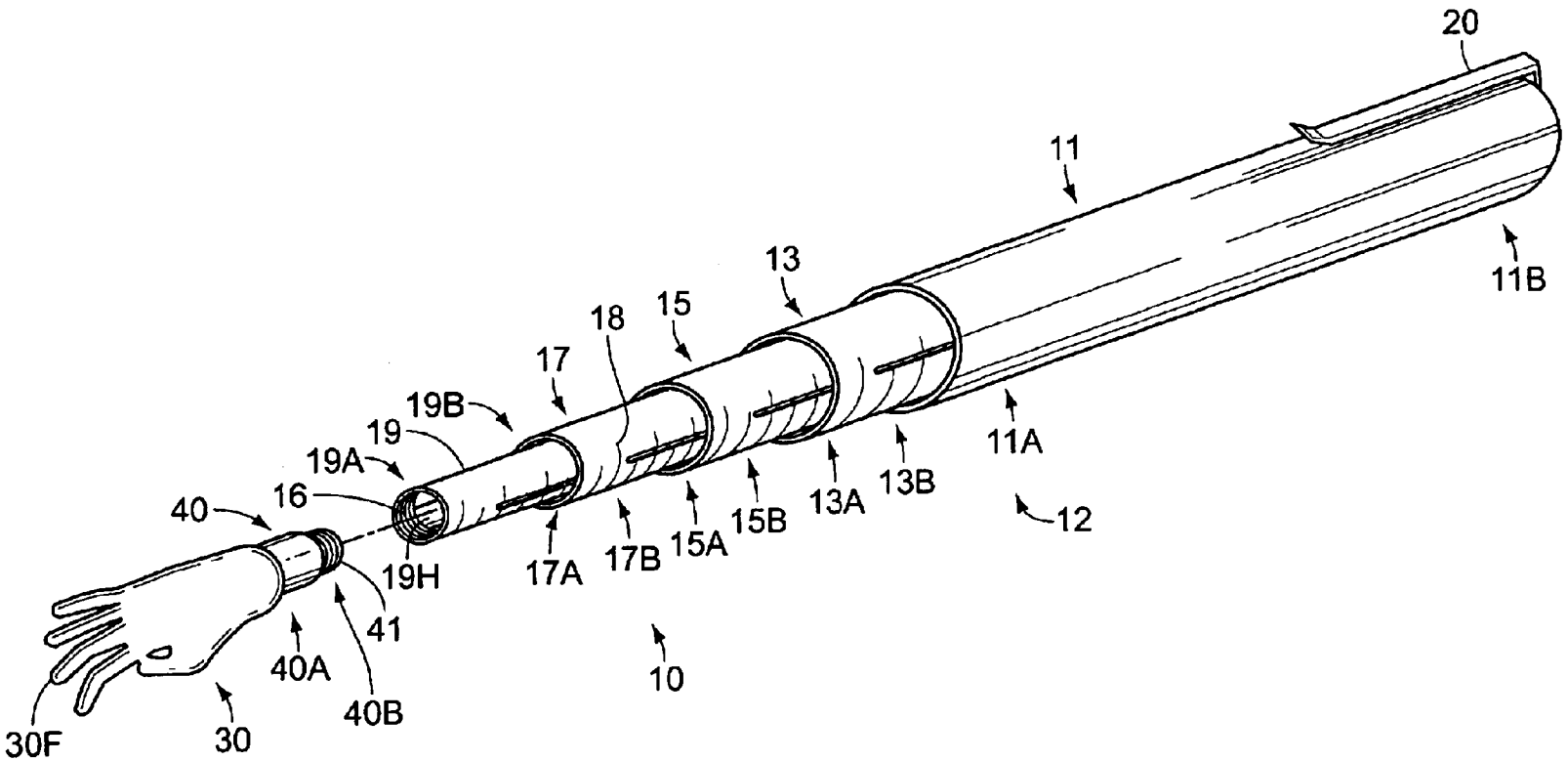
FIG. 1 is a perspective view of the backscratcher wherein the shaft has been partially telescopically extended, and wherein a backscratcher attachment end piece is positioned to be threaded within the attachment segment of the shaft.

FIG. 1 illustrates a perspective view of the backscratcher 10 having an elongated shaft 12 comprised of a plurality of segments, including an outermost segment 11, intermediate segments 13, 15, 17, and finally, an attachment segment 19. The shaft 12 has a storage position wherein the segments are retracted within one another, and also has a deployed position wherein the segments are extended away from one another. In FIG. 1, the segments 11, 13, 15, 17, and 19 have been partially telescopically extended with respect to one another as will be described in detail hereinafter. Attachment segment 19 has a first end 19A having an internal bore 19H having threads 16, and also has a second end 19B.

Figure 3:
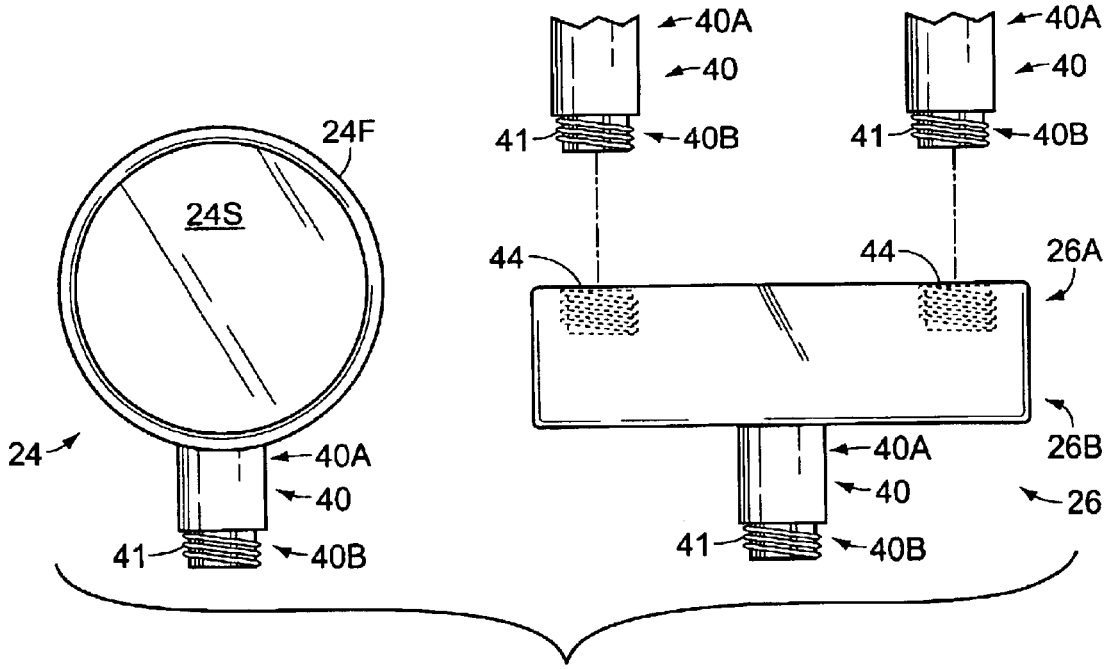
FIG. 3 is a front elevational view of the mirror attachment end piece and the multiple attachment end piece.
Figure 4:
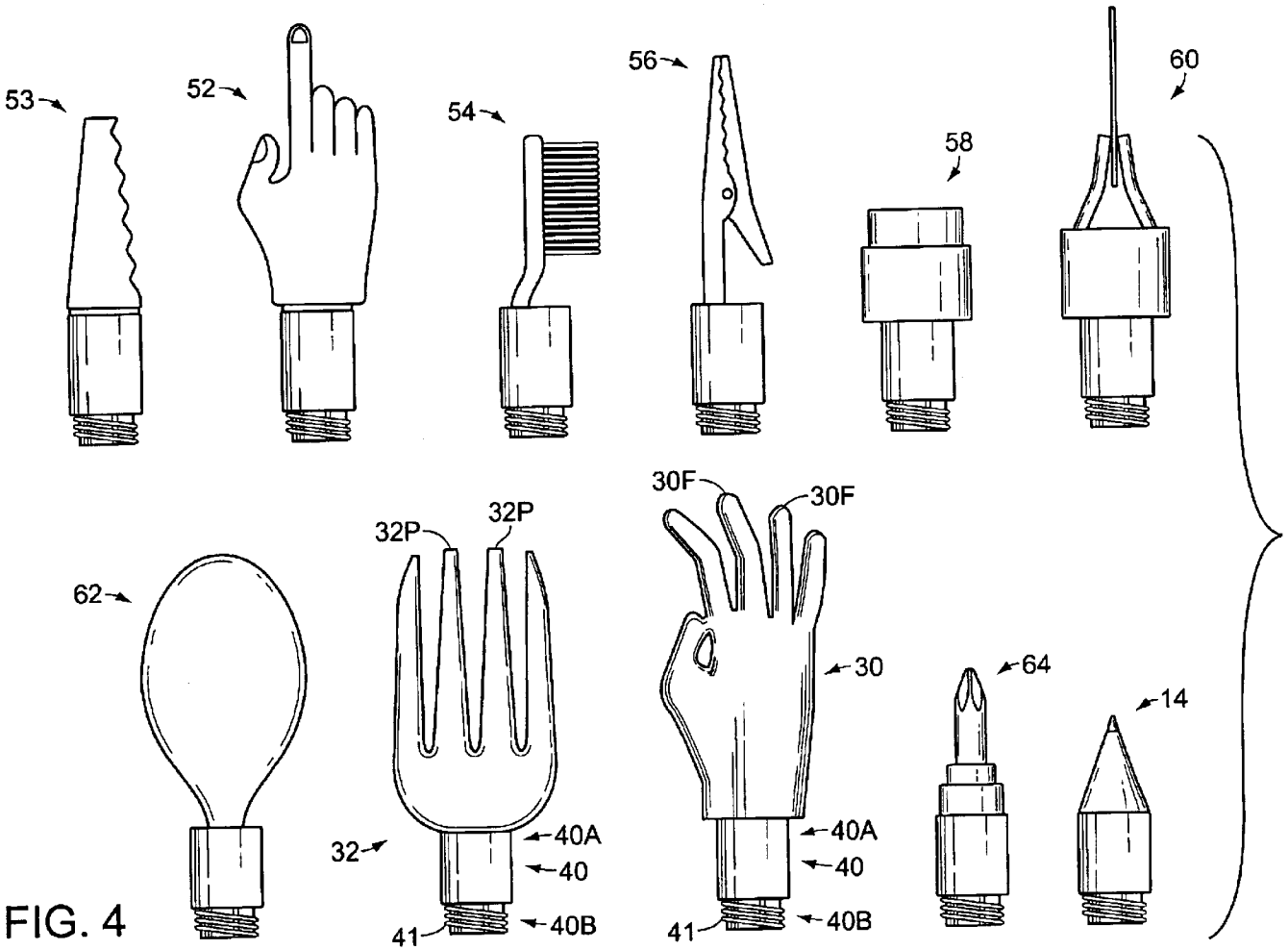
FIG. 4 is a front elevational view of a variety of attachment end pieces provided with the backscratcher.

The backscratcher 10 additionally comprises a plurality of attachment end pieces which may be selectively threaded into the threads 16 of attachment segment 19. In FIG. 1, the standard backscratcher attachment end piece 30 is positioned for attachment to the attachment segment 19. The standard backscratcher attachment end piece 30 is in the shape of a human hand and has five fingers 30F, four of which may be used for scratching a back of a user. A variety of other attachment end pieces are illustrated in FIG. 3 and FIG. 4, and are described hereinafter. These other end pieces allow the backscratcher 10 to be used for purposes in addition to merely scratching the back of the user. The mode of attachment of each attachment end piece to the attachment segment 19 of the shaft 12 is identical. Hence, a description of the mode of attachment of the standard backscratcher attachment end piece 30 will suffice as a description of the mode of attachment of all of the other end pieces illustrated in FIG. 3 and FIG. 4.

The standard backscratcher attachment end piece 30 has a cylindrical neck 40 which is selectively attachable to attachment segment 19. The neck 40 has a first end 40A and also has a second end 40B having threads 41. The threads 41 of the neck 40 match those of the threads 16 within the internal bore 19H of the attachment segment 19, thereby allowing the neck 40 of the standard backscratcher attachment end piece 30 to be attached to the attachment segment 19 by threading it within the internal bore 19H of the attachment segment 19.

In FIG. 1, the standard backscratcher attachment end piece 30 is positioned to be threaded within the attachment segment 19. Each of the other attachment end pieces illustrated in FIG. 3 has a substantially identical neck 40 also having threads 41, for selective attachment to the attachment segment 19 in a manner identical to that described above for the standard backscratcher attachment end piece 30.

Figure 2:
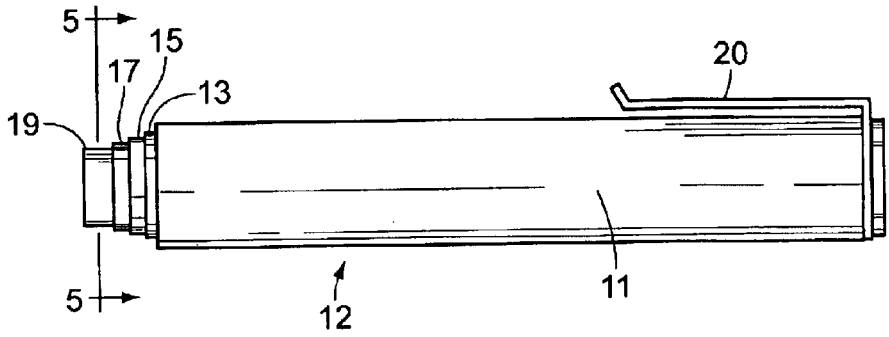
FIG. 2 is a side view of the backscratcher shaft, wherein the segments of the shaft have been retracted within one another, for storage of the backscratcher.

Referring to FIG. 1, the backscratcher 10 has a selectively extendable shaft 12, which is extended when the backscratcher 10 is being deployed, and which is retracted when the backscratcher 10 is being stored. In FIG. 1, the shaft 12 is partially extended. Each segment comprises a substantially cylindrical hollow tube. The outermost segment 11 has a first end 11A and a second end 11B. Likewise, each of the segments 13, 15, 17, and 19 also have a first end and a second end. The first end of each of these segments is that end which is further from the outermost segment 11 when the shaft 12 is extended. The second end of each of these segments is that end which is closer to the outermost segment 11 when the shaft 12 is extended. The first end of the segments 13, 15, 17, and 19 are labeled 13A, 15A, 17A, and 19A, respectively. The second end of the segments 13, 15, 17, and 19 are labeled 13B, 15B, 17B, and 19B, respectively. The outermost segment 11 has the widest inner diameter and outer diameter, and the intermediate segments 13, 15, 17 and the attachment segment 19 each have successively smaller inner diameters and outer diameters. This structure allows each of said successive segments to be fitted snugly into the adjacent segment positioned closer to the outermost segment 11 when the backscratcher 10 is stored, or alternately, to be extended from said adjacent segment when the backscratcher 10 is deployed. FIG. 2 illustrates the shaft 12 of the backscratcher 10 in its storage position, wherein the shaft 12 occupies minimal space, thereby allowing the backscratcher 10 to be conveniently kept in a pocket of a user. In this regard, the outermost segment 11 is provided with a clip 20 for selective attachment of the backscratcher 10 to the pocket of a user.

The backscratcher 10 further comprises measuring marks 18 on each of the segments, in units of millimeters and also inches, thereby allowing the shaft 12 of the backscratcher 10 to also be used as a measuring ruler, when the segments 11, 13, 15, 17, and 19 have been telescopically extended with respect to each other.

FIG. 3 illustrates a front elevational view of the mirror attachment end piece 24 and the multiple attachment end piece 26. The mirror attachment end piece 24 has a reflective surface 24S which is enclosed by a frame 24F. The mirror attachment end piece 24 is capable of providing reflected images of otherwise inaccessible places when it is attached to the backscratcher 10, after the shaft 12 has been extended.

The multiple attachment end piece 26 functions as an adapter which enables the user to attach more than one attachment end piece to the backscratcher 10 simultaneously. In this regard, the multiple attachment end piece 26 has a first end 26A and a second end 26B, and a neck 40 attached to the second end 26B. The first end 26A of the multiple attachment end piece 26 has two internal bores 44, each bore 44 having threads around its periphery, wherein each of said bores 44 is sized to accommodate the neck of any of the other end pieces. Two necks 40 of two other end pieces, with portions broken away for simplicity, are positioned for attachment to the multiple attachment end piece 26. Thus, by way of example, two of the standard backscratcher attachment end pieces 30 may be threaded within the bores 44 of the multiple attachment end piece 26, thereby allowing the user to scratch a larger area upon the back than would be possible with only a single backscratcher attachment end piece 30.

FIG. 4 illustrates a front elevational view of the variety of other attachment end pieces provided with the backscratcher 10. All of these end pieces have a neck 40 having threads 41, thereby allowing selective attachment of the end pieces to the bore 19A of the attachment segment 19 in the manner described above. These end pieces include a fork attachment end piece 32, a pen attachment end piece 14, a hand pointer end piece 52, an alligator teeth back scratcher end piece 53, a toothbrush attachment end piece 54, an alligator clip attachment end piece 56, a magnet attachment end piece 58, a card holder attachment end piece 60, a spoon attachment end piece 62, and a Phillips screwdriver attachment end piece 64. The use of most of these end pieces is apparent and need not be described in detail herein.

In particular, however, the fork attachment end piece 32 has a plurality of prongs 32P, which allow it to be used to ensnare food. The hand pointer end piece 52 may be used in conjunction with an overhead projector to point out particular areas of interest on a projected image. The alligator clip attachment end piece 56 may be used to clamp a variety of objects. The magnet end piece 58 includes a permanent magnet and may be used to retrieve small ferromagnetic objects from otherwise inaccessible places. The card holder end piece 60 may be used by a user to hold a business card (as shown) and to extend that business card to someone else.

Figure 5:
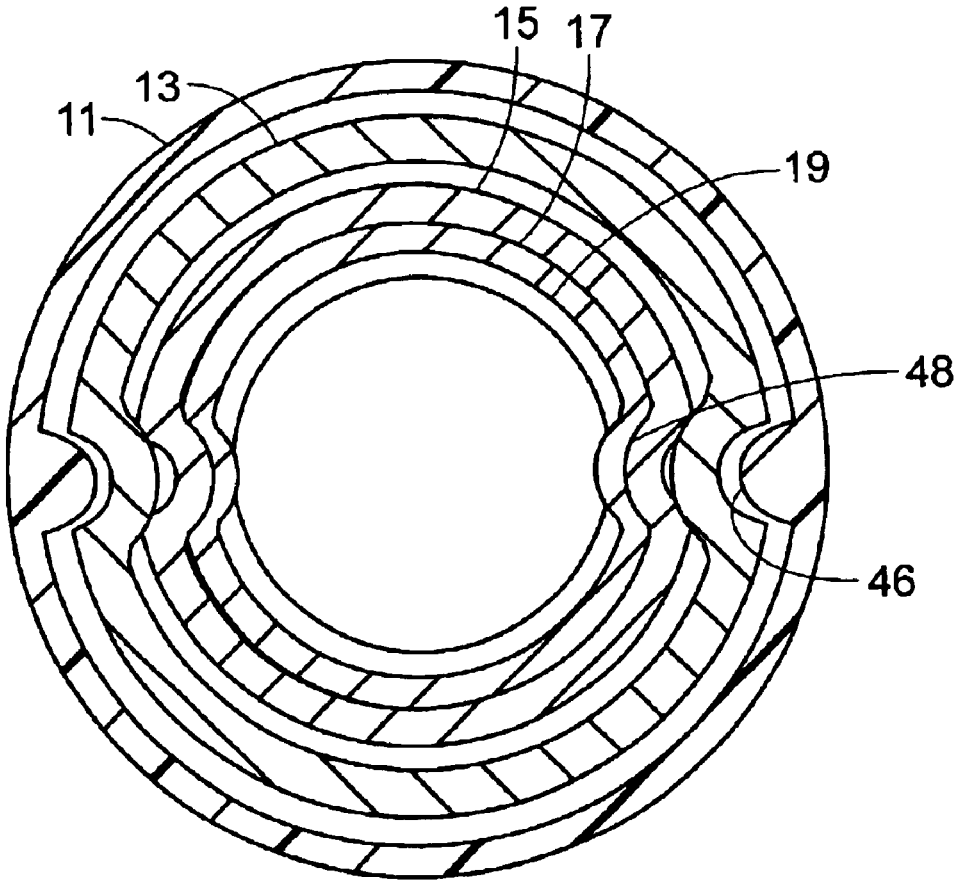
FIG. 5 is a cross-sectional view taken along line 5—5 in FIG. 2, illustrating the segments of the shaft positioned within one another, for storage of the backscratcher.

FIG. 5 illustrates a cross-sectional view taken along line 5—5 in FIG. 2, illustrating the segments positioned within one another when the shaft 12 is in the storage position. Each of the intermediate segments 13, 15, and 17 has an outer surface having a longitudinal groove 48, and also an inner surface having a longitudinal protuberance 46. Additionally, the outermost segment 11 has an inner surface having a longitudinal protuberance 46. Finally, the attachment segment 19 has a longitudinal groove 48 on its outer surface. The grooves 48 and the interlocking corresponding protuberances 46 prevent the segments from rotating with respect to one another, thereby preventing rotation of the attachment end piece which has been secured to the shaft 12, and keeps the measuring marks 18 aligned.

The backscratcher 10 is provided in a variety of sizes. In particular, the backscratcher 10 is provided in a size which is approximately the same size as a standard pen. Alternately, the backscratcher 10 may be sized to fit onto a key chain. A larger version is also available for use in the home. The hands upon the standard backscratcher attachment end piece 30 and on the hand pointer end piece 52 may be configured to represent either a left hand or a right hand.

In use, a user determines which of the various attachment end pieces is to be used. The user then selectively attaches that end piece to attachment segment 19 of the backscratcher 10. The user adjusts the length of the shaft 12 by telescopically extending the segments. The backscratcher 10 is then ready to be used in a manner consistent with the particular end piece which has been attached to the shaft 12. When finished using the backscratcher 10, the segments are telescopically retracted within one another, thereby allowing compact storage of the backscratcher 10. The user may store the backscratcher 10 in the pocket on an item of clothing, by use of the clip 20 provided for this purpose.

In conclusion, herein is presented a backscratcher with a telescopically adjustable shaft and a plurality of interchangeable screw-on attachment end pieces. The invention is illustrated by example in the drawing figures, and throughout the written description. It should be understood that numerous variations are possible, while adhering to the inventive concept. Such variations are contemplated as being a part of the present invention.

What is claimed is:

1. A backscratcher, for relieving the itch of a user in hard-to-reach areas, comprising:

a telescopically adjustable shaft having a plurality of concentric tubular segments, including an outermost segment and an attachment segment;

a standard backscratcher attachment end piece, selectively attachable to said attachment segment;

at least one additional attachment end piece selected from the group consisting of a mirror attachment end piece, a pen attachment end piece, a fork attachment end piece, a spoon attachment end piece, an alligator teeth back scratcher end piece, a hand pointer end piece, a business card holder attachment end piece, a toothbrush attachment end piece, a Phillips screwdriver attachment end piece, a magnet attachment end piece, an alligator clip attachment end piece, and a multiple attachment end piece, wherein said multiple attachment end piece is itself capable of being selectively attached to more than one of the other end pieces; and a clip on the outermost segment for selective attachment to a pocket on an item of clothing worn by the user, wherein the plurality of concentric tubular segments includes at least one intermediate segment extending between the attachment segment and the outermost segment, wherein the telescopically adjustable shaft further comprises longitudinal protuberances upon the inner surfaces of all the segments except the attachment segment, and wherein the telescopically adjustable shaft further comprises longitudinal grooves within the outer surface of each of the segments except the outermost segment, thereby preventing rotation of each segment with respect to the other segments, and thereby preventing rotation of the attachment end piece which is secured to the attachment segment.

2. The backscratcher as recited in claim 1, further comprising measuring marks on at least two of the segments, thereby allowing the shaft of the backscratcher to be used as a measuring ruler for measuring the length of a variety of objects.

3. A backscratcher, for use in relieving the itch of a user in hard-to-reach areas, comprising:

a telescopically adjustable shaft having a plurality of concentric tubular segments, including an outermost segment and an attachment segment;

a standard backscratcher attachment end piece, selectively attachable to said attachment segment; and a plurality of additional attachment end pieces including a mirror attachment end piece, a pen attachment end piece, a fork attachment end piece, a spoon attachment end piece, an alligator teeth back scratcher end piece, a hand pointer end piece, a business card holder attachment end piece, a toothbrush attachment end piece, a Phillips screwdriver attachment end piece, a magnet attachment end piece, an alligator clip attachment end piece, and a multiple attachment end piece, wherein said multiple attachment end piece is itself capable of being selectively attached to more than one of the other end pieces.

* * * * *